US006220493B1

(12) United States Patent
Iijima et al.

(10) Patent No.: US 6,220,493 B1
(45) Date of Patent: Apr. 24, 2001

(54) MULTI-WAY BAG

(76) Inventors: Norihiro Iijima; Teruyo Iijima, both of Room 311 7-1, Oonodai 2-chome Sagamihara-shi Kanagawa (JP)

( * ) Notice: Subject to any disclaimer, the term of this patent is extended or adjusted under 35 U.S.C. 154(b) by 0 days.

(21) Appl. No.: 09/512,604

(22) Filed: Feb. 25, 2000

Related U.S. Application Data

(63) Continuation-in-part of application No. 09/097,110, filed on Jun. 12, 1998, now abandoned, which is a continuation-in-part of application No. 08/851,001, filed on May 5, 1997, now abandoned.

(51) Int. Cl.[7] ..... A45F 4/02
(52) U.S. Cl. ..... 224/578; 224/153; 224/673
(58) Field of Search ..... 224/153, 578–583, 224/600–603, 605, 607–612, 627, 219, 221, 222, 660, 663, 664, 665, 666, 673, 674; 150/107–110; 190/115, 116

(56) References Cited

U.S. PATENT DOCUMENTS

| | | | | |
|---|---|---|---|---|
| 3,997,092 | * | 12/1976 | Pogwizd | 224/610 |
| 4,810,102 | * | 3/1989 | Norton | 224/578 X |
| 4,836,428 | * | 6/1989 | Evans et al. | 224/674 X |
| 4,998,653 | * | 3/1991 | LaBelle | 224/578 |
| 5,415,332 | * | 5/1995 | Kliot | 224/578 X |
| 5,526,924 | * | 6/1996 | Klutznick | 224/673 X |
| 5,577,652 | * | 11/1996 | Cooper | 224/578 |
| 5,586,703 | * | 12/1996 | Radar et al. | 224/601 |

FOREIGN PATENT DOCUMENTS

| | | | | |
|---|---|---|---|---|
| 693272 | * | 6/1940 | (DE) | 224/209 |
| 2394268 | * | 1/1979 | (FR) | 150/110 |
| 409294618 | * | 6/1940 | (JP) | 224/578 |

* cited by examiner

*Primary Examiner*—Gregory M. Vidovich

(57) ABSTRACT

A multi-way bag comprises, in combination, a bag and a length-adjustable strap for carrying the bag. Preferably, the bag comprises front and back panels, a pair of side panels and top and bottom panels. The bag has four pairs of strap guides which allow the strap to pass therethrough, four connectors for connecting the strap to the bag so that the bag is supportable by a user with the strap. The connectors connect the strap to the bag such that the bag is supportable by means of the strap in one of a plurality of configurations selected by the user. The strap guides are mounted on the top and bottom panels with two pairs each on each panel at portions near both ends thereof. Each connector is rotatably and slidably mounted inside each pair of the strap guides so as to be rotatable about the longitudinal axis of each of the top and bottom panels and to be slidable therealong. Four pairs of slits are formed in the back panel in such a manner that each two pairs of the slits are opposed to each other. The bag can be carried as an arm-holding bag, a handbag, a shoulder bag, a rucksack, a wrist bag, a waist bag or the like.

9 Claims, 9 Drawing Sheets

MULTI-WAY BAG

This is a continuation-in part application of application Ser. No. 09/097,110 filed on Jun. 12, 1998 which is a continuation-in part of application Ser. No. 08/851,001 filed on May 5, 1997 both abandoned.

SPECIFICATION

BACKGROUND OF THE INVENTION

1. Field of the Invention

The present invention relates generally to bags, and more particularly to a multi-way bag that can be carried as an arm-holding bag, a handbag, a shoulder bag, a rucksack, a wrist bag, a waist bag or the like.

2. Description of the Prior Art

Multi-way bags are known. For example, DE. Pat. No. 693,272 (Weber) discloses a multi-way bag which is a kind of draw-string bag having at it's top end an opening which can be closed by means of a strap.

Also, multi-way bags are disclosed in publications, such as U.S. Pat. Nos. 5,416,332 (Kliot), 5,526,924 (Klutznick), 4,998,653 (LaBelle), 5,577,652 (Cooper) and 4,810,102 (Norton) and FR. Pat. No. 2,394,268 (Llombart et al.). However, there has heretofore been no such a multi-way bag as can be used as an arm-holding bag, a handbag, a shoulder bag, a rucksack, a wrist bag, a waist bag or the like.

SUMMARY OF THE ENVENTION

The present invention is intended to provide an improved multi-way bag which comprises, in combination: a bag comprising front and back panesl, a pair of side panels, a top panel and a bottom panel; a length-adjustable strap for carrying the bag; four pairs of strap guides allowing said strap to pass therethrough and comprising first two pairs of strap guides and second two pairs of strap guides; and four connectors for connecting said strap to said bag so that said bag is supportable by a user with said strap; said connectors connecting said strap to said bag such that said bag is supportable by means of said strap in one of a plurality of configurations selected by the user, said first two pairs of the strap guides extending transversely of and being fixedly mounted on said top panel such that one of said two pairs is located at a portion near one end of said top panel and the other of said two pairs is located at a portion near the other end of said top panel, said second two pairs of the strap guides extending transversely of and being fixedly mounted on the bottom panel such that one of said two pairs is located at a portion near one end of said bottom panel and the other of said two pairs is located at a portion near the other end of said bottom panel, each of said four connectors being rotatably and slidably mounted inside each pair of said strap guides so as to be rotatable about the longitudinal axis of each of said top and bottom panels and to be slidable along said longitudinal axis for a predetermined distance.

It is, therefore, the principal object of the present invention to provide a multi-way bag which can be carried as an arm-holding bag, a handbag, a shoulder bag, a rucksack, a wrist bag, a waist bag or the like.

Other objects and features of the present invention will become apparent from the following description made in conjunction with the accompanying drawings.

BRIEF DESCRIPTION OF THE DRAWINGS

FEG. 1 is a perspective view of the bag and strap as one embodiment of the present invention.

DETAILED DESCRIPTION OF THE INVENTION

Figure 1:
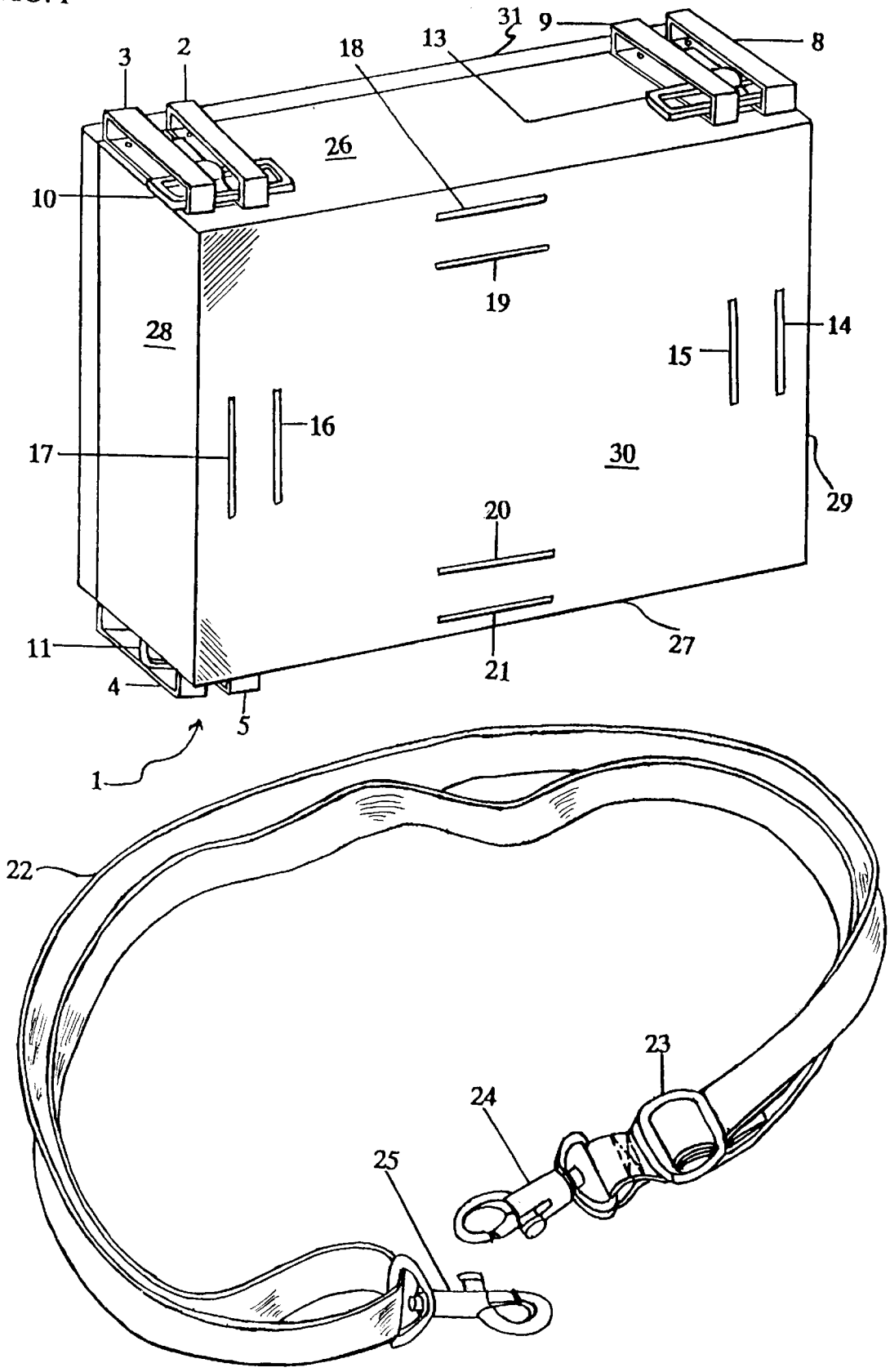
Figure 2:
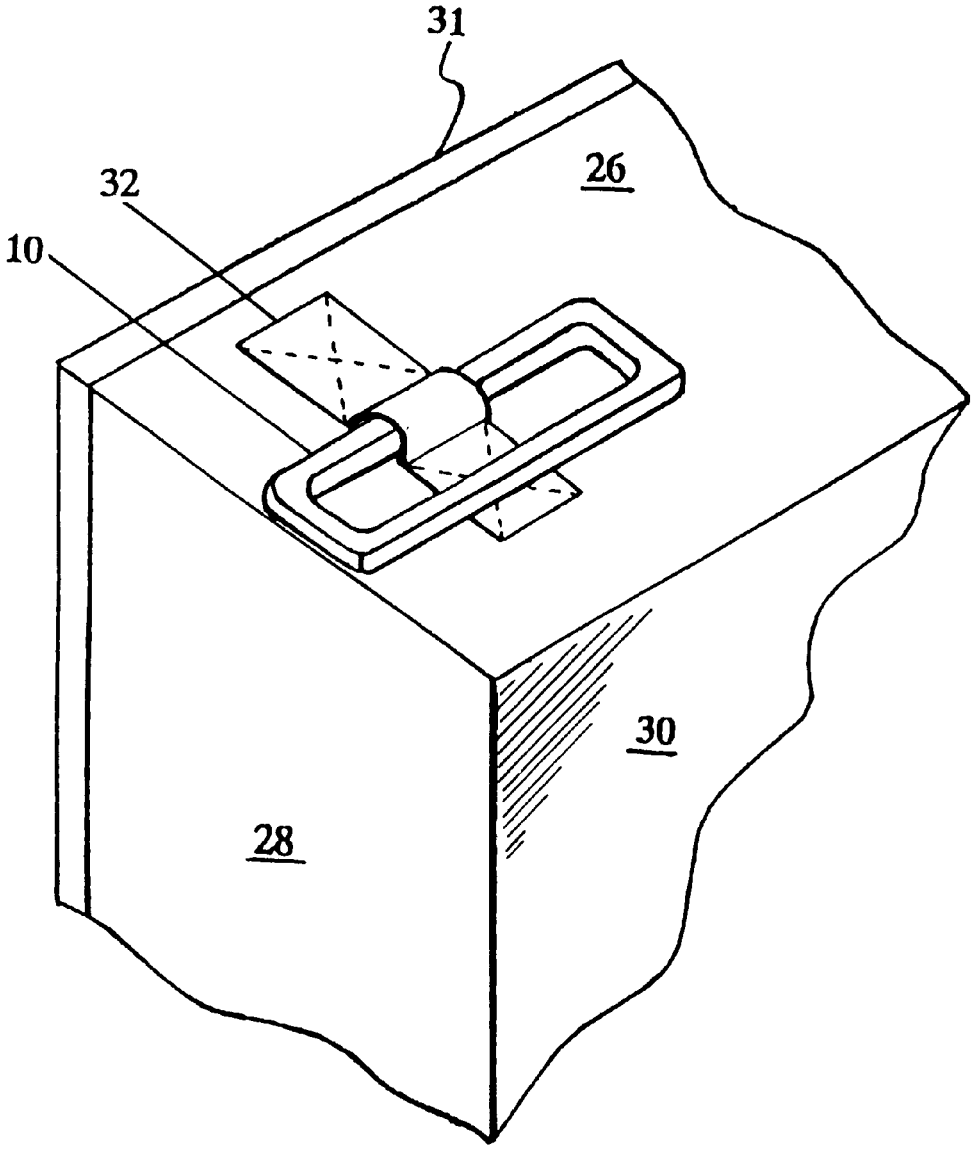
FIG. 2 is a perspective view, in an enlarged scale, of a connector and a clasp located at a portion near one end of the top panel of the bag shown in FIG. 1 from which a pair of strap guides has been removed.

Referring now to the drawings, in FIGS. 1 through 9, there is shown a multi-way bag as one embodiment of the present invention. The multi-way bag comprises, in combination, a bag 1 and a length-adjustable strap 22 for carrying the bag.

Preferably, the bag comprises a top panel 26, a bottom pamel 27, a pair of side panels 28, 29, a back panel 30 and an openable front panel 31.

The bag is provided with four pairs of strap guides 2, 3, 4, 5, 6, 7, 8, 9 which allow the strap to pass therethrough, four connectors 10, 11, 12, 13 for connecting the strap 22 to the bag so that the bag is supportable by a user with the strap 22 and four pairs of slits 14, 15, 16, 17, 18, 19, 20, 21 each pair of which allows the strap 22 to pass therethrough.

In the illustrated embodiment, the strap guides are fixedly mounted on the top and bottom panels 26 and 27 with two pairs each on each panel at portions near both ends thereof. Alternatively, however, the strap guides may be mounted on the side panels 28, 29 in a similar manner. Eeach of the connectors 10, 11, 12, 13 is rotatably and slidably mounted inside each pair of the strap guides so as to be rotatable about the longitudinal axis of each of the opposite panels 26 27 and to be slidable along said longitudinal axis for a predetermined distance. The four pairs of the slits are formed in the back panel 30 in such a manner that each two pairs of the slits are opposed to each other.

The strap 22 is of a double-strap type and has at one end a first spring hook 24 and at the other end a second spring hook 25. These hooks are releasably connectable with each other and with each of the connectors 10, 11, 12, 13 of the bag 1 and has an adjustment buckle 23 for adjusting the length of the strap 22.

In the illustrated embodiment, two pairs of strap guides 2, 3 and 8, 9 are located at portions near both ends of the top panel 26, respectively, while the other two pairs of strap guides 4, 5 and 6, 7 are located at portions near both ends of the bottom panel 27, respectively.

However, the four pairs of strap guides may be mounted on the side panels 28, 29 with two pairs each on each side panel at portions near both ends thereof.

In the illustrated embodiment, each strap guide 2, 3, 4, 5, 6, 7, 8, 9 has a rectangular cross-section shape. However, it may have an arch, arcuate or U cross-section shape.

As shown in FIGS. 1 through 8, each pair of the strap guides extends transversely of each of the top and bottom panels 26, 27 in parallel spaced-apartrelationship, respectively.

As shown in FIG. 1, each connector 10, 11, 12, 13 is preferably shaped like a rectangular frame. However, it may be of an elongated elliptical shape.

Each of the connectors is movably mounted by means of a transversely extending elongated clasp 32, 33, 34, 35 with an arcuate passage which allows each connector 10, 11, 12, 13 to rotate about the longitudinal axis of each of the opposite panels 26, 27 and to slide along said axis for a predetermined distance.

As clearly shown in FIG. 1, a first pair of slits 14, 15 is formed in the back panel 30 on the right hand side thereof, a second pair of slits 16, 17 is formed in the back panel on the left hand side thereof, a third pair of slits 18, 19 is formed in the back panel on the upper side thereof and a fourth pair of slits 20, 21 is formed in the back panel on the lower side thereof.

Figure 9:
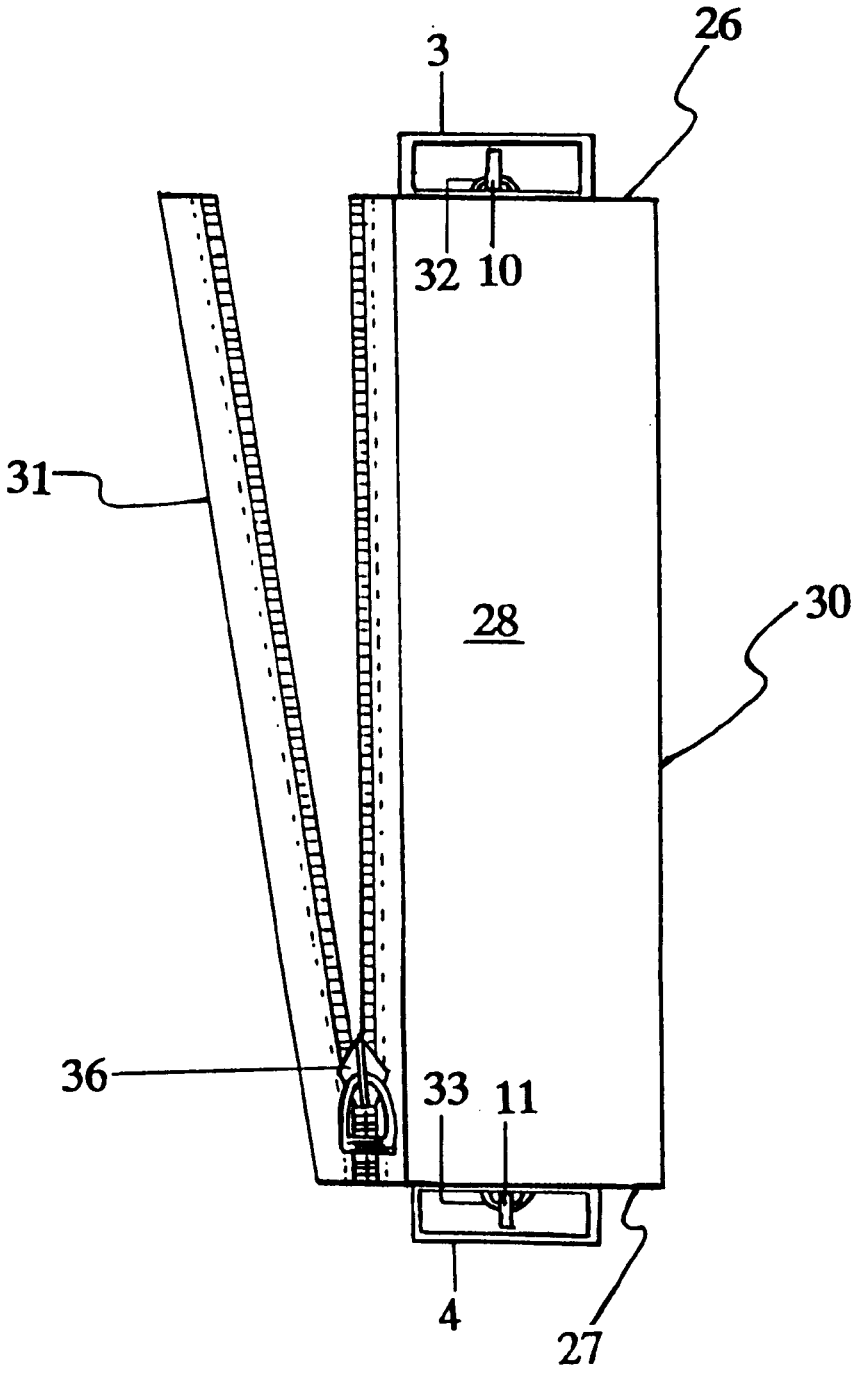
FIG. 9 is a side view of the bag with a zip fastener, illustrating the state in which the bag is about to be fully opened by manipulation of the zip fastener.

As shown in FIG. 9, the openable front panel 31 is a flap panel swingably attached at a lower end thereof to a front edge of the bottom panel 27 and arranged to be opened and closed by means of a zip fastener 36.

Figure 3:
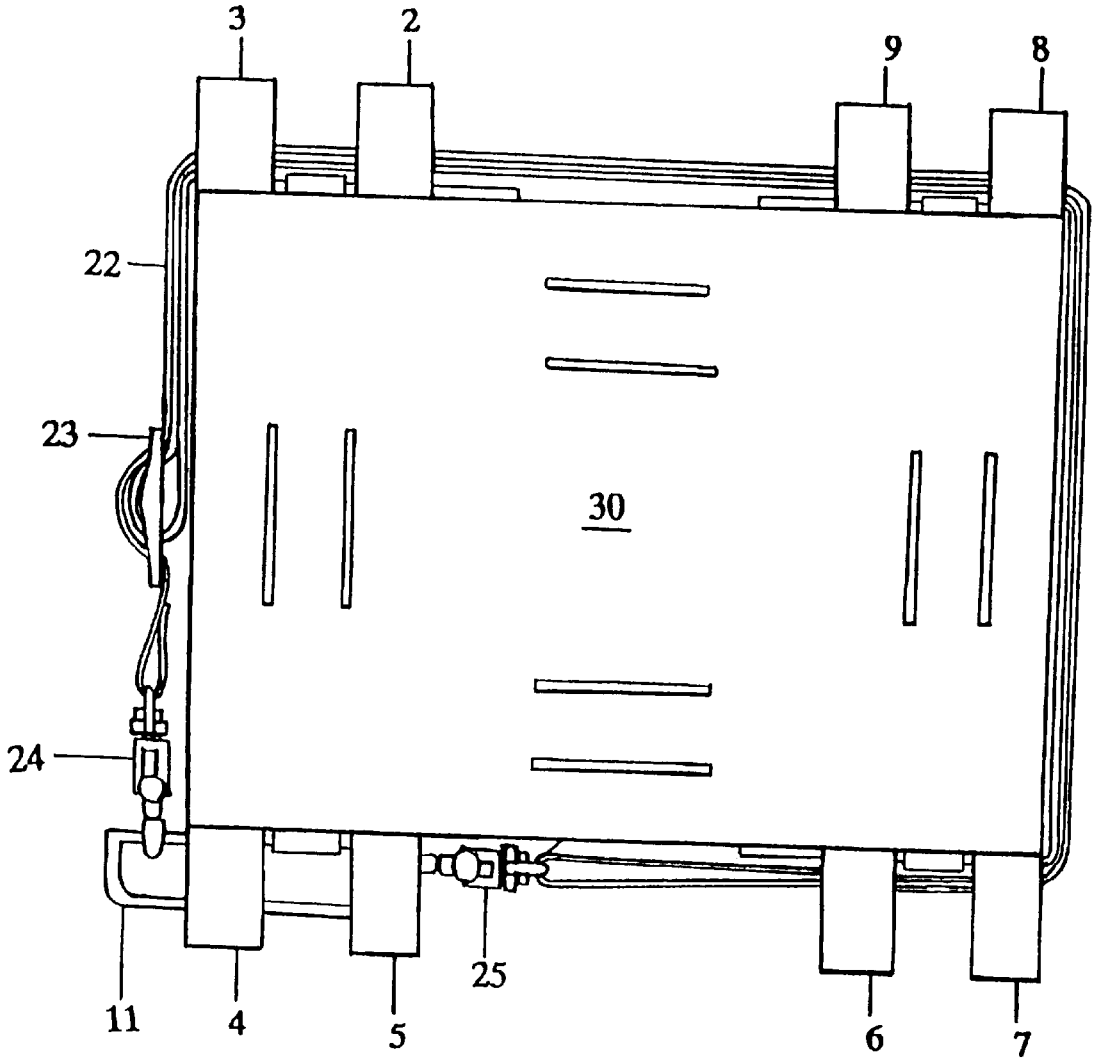
FIG. 3 is a rear view of the bag with the strap shown in FIG. 1, illustrating a manner in which the bag is configured to an arm-holding bag.

FIG. 3 illustrates a manner in which the bag is configured to an arm-holding bag as one of configurations that can be selected by the user.

As may be seen from FIG. 3, first, the first spring hook 24 of the strap 22 is connected to a connector 11. Next, the second spring hook 25 is made to pass through the strap guides 3, 2, 9, 8, 7, 6 one after another. Then, the second spring hook 25 is connected to the connector 11. After that, the length of the strap 22 is adjusted so as to be suitable for carrying the bag as an arm-holding bag by manipulating the buckle 23. Thus, the bag having an arm-holding bag mode can be provided.

Figure 4:
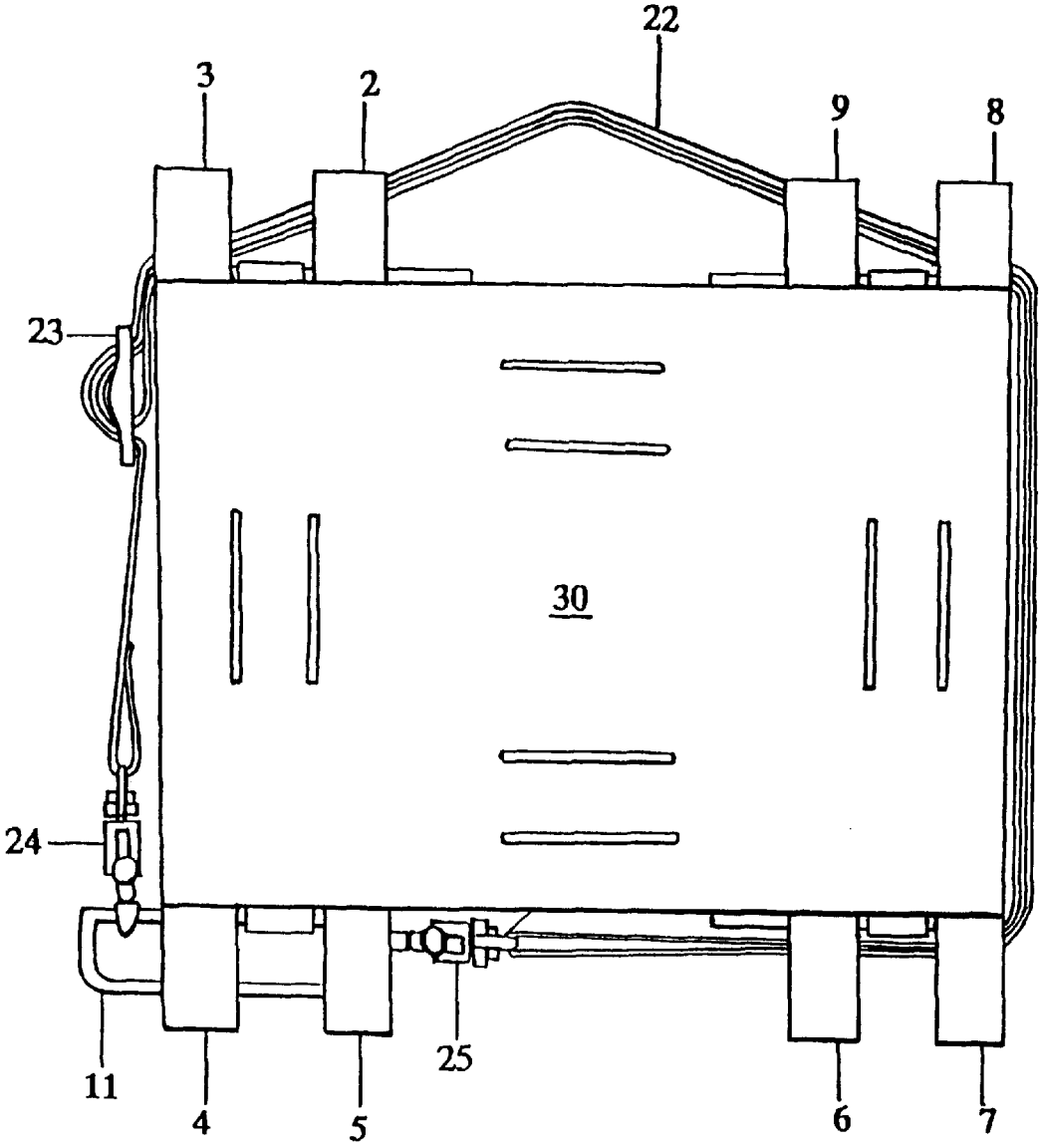
FIG. 4 is a rear view of the bag with the strap shown in FIG. 1, showing a manner in which the bag is configured to a handbag.

FIG. 4 shows a manner in which the bag is configured to a handbag as another example of bag configuration that can be selected by the user.

As may be seen from FIG. 4, first, spring hook 24 is connected to a connector 11. Next, the other spring hook 25 is made to pass through the strap guides 3, 2, 9, 8, 7, 6 one after another. Then, the other spring hook 25 is connected to the connector 11. Thereafter, the length of the strap 22 is adjusted so as to be suitable for carrying the bag as a handbag. In this way, the bag having a handbag mode can be provided.

Figure 5:
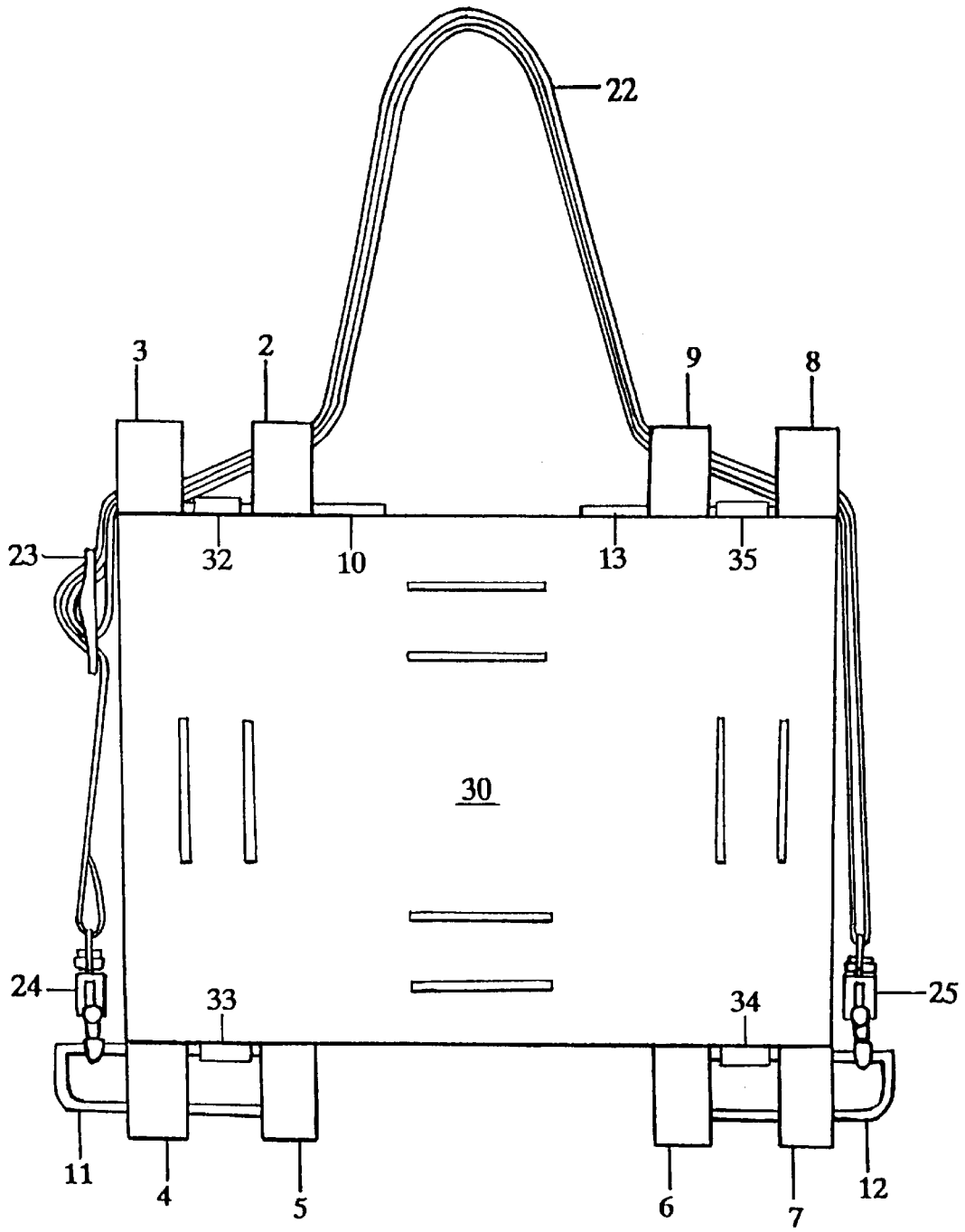
FIG. 5 is a rear view of the bag with the strap shown in FIG. 1, illustrating a manner in which the bag is configured to a shoulder bag.

FIG. 5 illustrates a manner in which the bag is configured to a shoulder bag.

As may be seen from FIG. 5, first, the first spring hook 24 is connected to a connector 11. Next, the second spring hook 25 is made to pass through the strap guides 3, 2, 9, 8 one after nother. Then, the second spring hook 25 is connected to a connector 12. After that, the length of the strap 22 is adjusted so that the bag is capable of being carried by the user in the form of a shoulder bag.

In this case, the buckle 23 is manipulated so as to lengthen the strap 22 to a length sufficient for carrying the bag as a shoulder bag. Thus, the bag having a shoulder bag mode can be provided.

Figure 6:
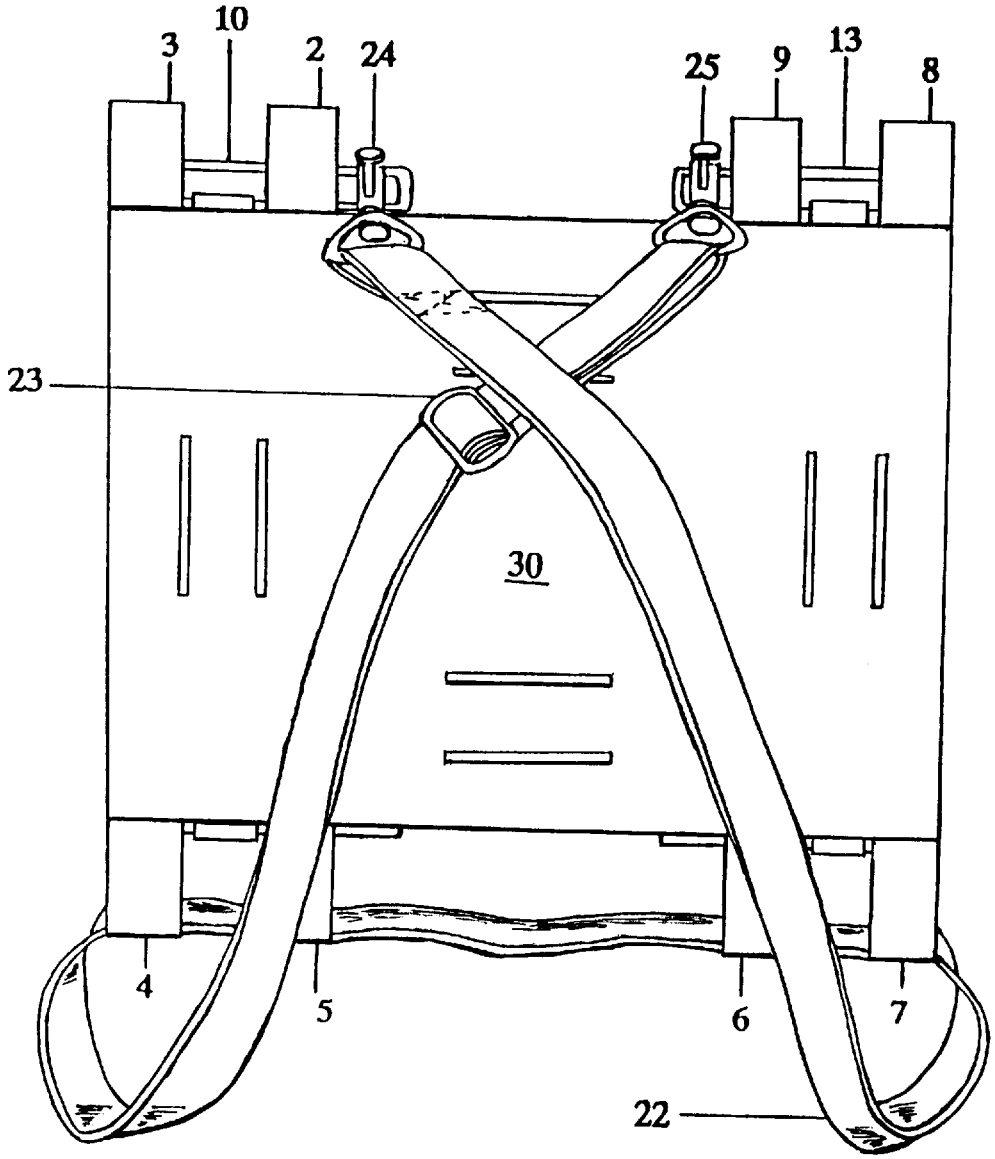
FIG. 6 is a rear view of the bag with the strap shown in FIG. 1, showing a manner in which the bag is configured to a rucksack.

FIG. 6 shows a manner in which the bag is configured to a rucksack.

As may be seen from FIG. 6, first, the length of the strap 22 is roughly adjusted for a rucksack. Next, the second spring hook 25 is connected to a connector 13. Then, the first spring hook 24 is made to pass through the strap guides 4, 5, 6, 7 one after another. After that, the first spring hook 24 is connected to a connector 10 so that the strap 22 is crossed in the form of X as shown in FIG. 6.

Furthermore, the length of the strap 22 is adjusted so as to be suitable for carrying the bag as a rucksack. In this way, the bag having a rucksack mode can be provided.

Figure 7:
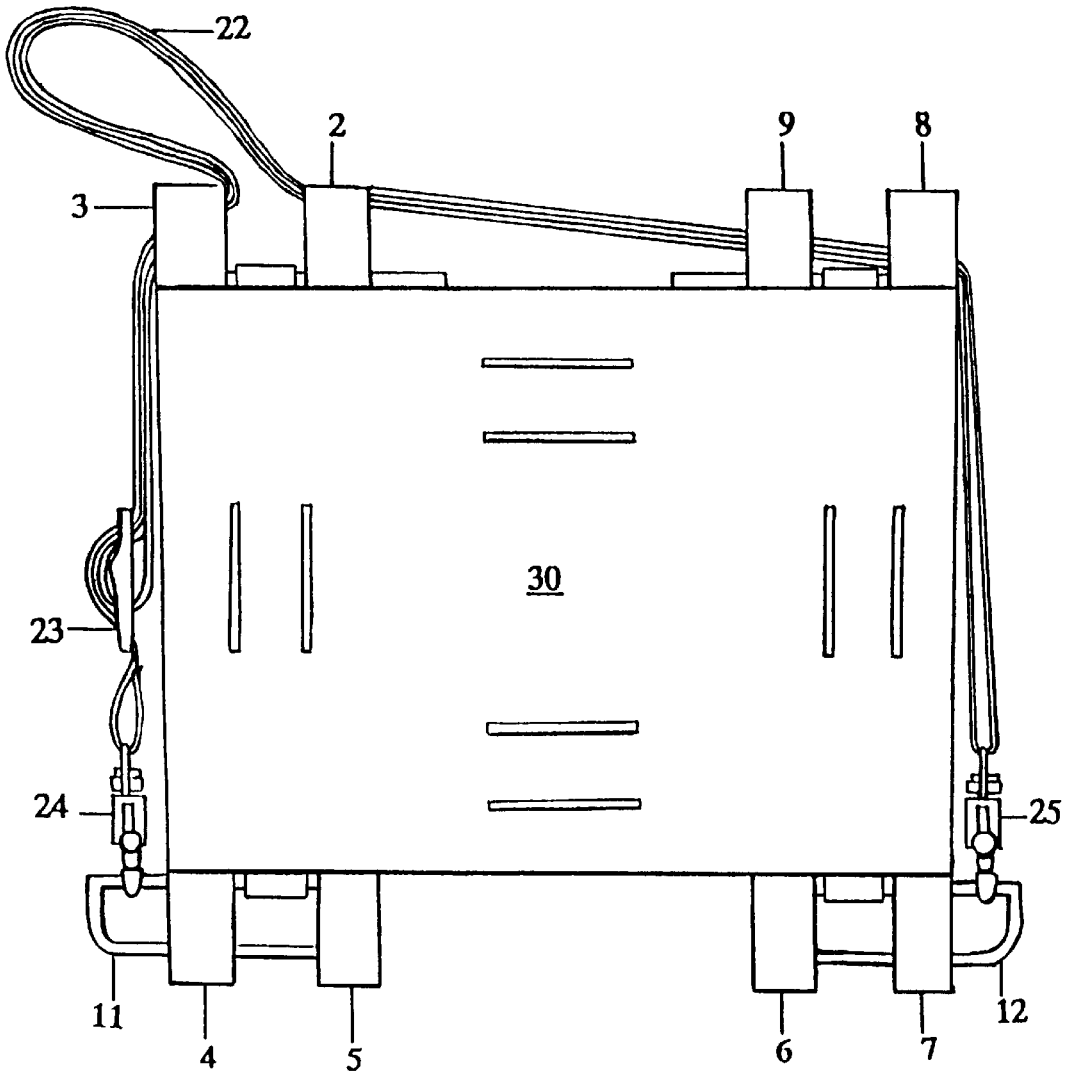
FIG. 7 is a rear view of the bag with the strap shown in FIG. 1, illustrating a manner in which the bag is configured to a wrist bag.

FIG. 7 illustrates a manner in which the bag is configured to a wrist bag.

As may be seen from FIG. 7, first, the first spring hook 24 is connected to a connector 11. Next, the second spring hook 25 is made to pass through the strap guides 3, 2, 9, 8 one after another. Then, the second spring hook 25 is connected to another connector 12. After that, a part of the strap 22 is pulled up from beween the pair of strap guides 2 and 3. Furthermore, the length of the strap 22 is adjusted so as to be suitable for carrying the bag as a wrist bag. Thus, the bag having a wrist bag mode can be provided.

Figure 8:
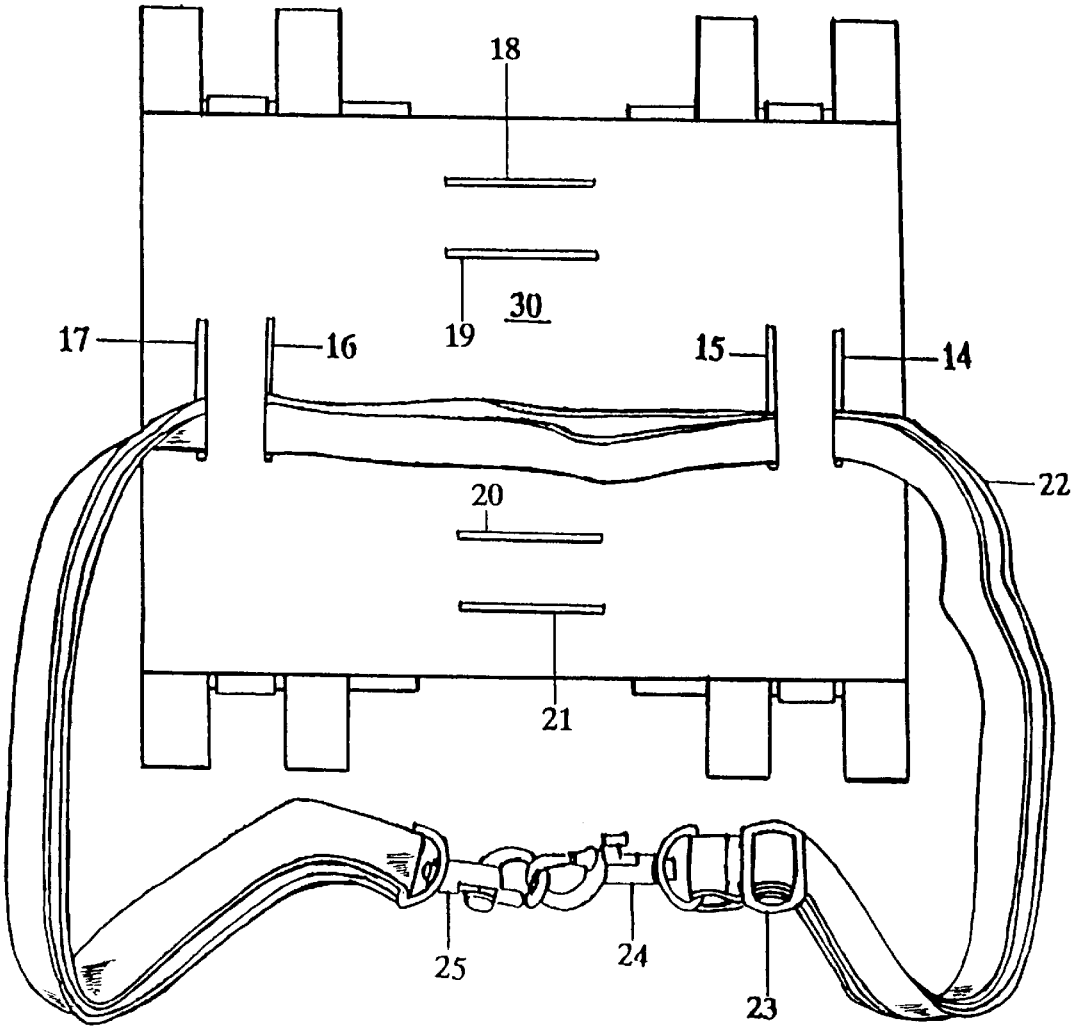
FIG. 8 is a rear view of the bag with the strap shown in FIG. 1, showing a manner in which the bag is configured to a waist bag.

FIG. 8 illustrates a manner in which the bag is configured to a waist bag.

As may be seen from FIG. 8, first, the second spring hook 25 is made to pass through the slits 14, 15, 16, 17 one after another. Next, the spring hook 25 is connected to the first spring hook 24. Then, the length of the strap 22 is adjusted so as to be suitable for carrying the bag as a waist bag. In this way, the bag having a waist bag mode can be provided.

To provide such a waist bag, the first spring hook 24 is directly connected with the second spring hook 25. In this case, there is no necessity of using the above-mentioned connectors of the bag.

Thus, as may be seen from the foregoing, according to the present invention a multi-way bag is provided which can be carried as an arm-holding bag, a handbag, a shoulder bag, a rucksack, a wrist bag, a waist bag or the like.

What is claimed is:

1. A multi-way bag comprising, in combination: a bag comprising front and back panels, a pair of side panels, a top panel and a bottom panel; a length-adjustable strap for carrying the bag; four pairs of strap guides allowing said strap to pass therethrough and comprising first two pairs of strap guides and second two pairs of strap guides; and four connectors for connecting said strap to said bag so that said bag is supportable by a user with said strap; said connectors connecting said strap to said bag such that said bag is supportable by means of said strap in one of a plurality of configurations selected by the user, said first two pairs of the strap guides extending transversely of and being fixedly mounted on said top panel such that one of said two pairs is located at a portion near one end of said top panel and the other of said two pairs is located at a portion near the other end of said top panel, said second two pairs of the strap guides extending transversely of and being fixedly mounted on the bottom panel such that one of said two pairs is located at a portion near one end of said bottom panel and the other of said two pairs is located at a portion near the other end of said bottom panel, each of said four connectors being rotatably and slidably mounted inside each pair of said strap guides so as to be rotatable about the longitudinal axis of each of said top and bottom panels and to be slidable along said longitudinal axis for a predetermined distance.

2. A multi-way bag as claimed in claim 1, wherein each pair of said strap guides is arranged in parallel spaced-apart relationship, respectively.

3. A multi-way bag as claimed in claim 1, wherein said front panel is a flap panel swingably attached at a lower end thereof to a front edge of said bottom panel and arranged to be opened and closed by means of a zip fastener.

4. A multi-way bag as claimed in claim 1, wherein said bag has four pairs of slits which allow the strap to pass therethrough and which are formed in the back panel in such a manner that each two pairs of the slits are opposed to each other.

5. A multi-way bag as claimed in claim 1, wherein each of said connectors takes the form of a rectangular frame whose longitudinal axis extends in paralled with the longitudinal axis of each of said top and bottom panels and wherein said strap has at one end a first spring hook and at the other end a second spring hook, each of said first and second spring hooks being releasably connectable with each other and with each of said connectors.

6. A multi-way bag comprising, in combination: a bag comprising front and back panels, a pair of side panels, a top panel and a bottom panel; a length-adjustable strap for carrying the bag; four pairs of strap guides allowing said strap to pass therethrough and comprising first two pairs of strap guides and second two pairs of strap guides; and four connectors for connecting said strap to said bag so that said bag is supportable by a user with said strap; said strap having at one end a first spring hook and at the other end a second spring hook, each of said first and second spring hooks being releasably connectable with each other and with each of said connectors, said connector connecting said strap to said bag such that said bag is supportable by means of said strap in one of a plurality of configurations selected by the user, said first two pairs of the strap guides extending transversely of and being fixedly mounted on said top panel such that one of said two pairs is located at a portion near one end of said top panel and the other of said two pairs is located at a portion near the other end of said top panel, said second two pairs of the strap guides extending transversely of and being fixedly mounted on the bottom panel such that one of said two pairs is located at a portion near one end of said bottom panel and the other of said two pairs is located at a portion near the other end of said bottom panel, each pair of said strap guides being arranged in parallel spaced-apart relationship, respectively, each of said four connectors being rotatably and slidably mounted inside each pair of said strap guides so as to be rotatable about the longitudinal axis of each of said top and bottom panels and to be slidable along said longitudinal axis for a predetermined distance.

7. A multi-way bag as claimed in claim 6, wherein each of said connectors takes the form of a rectangular frame whose longitudinal axis extends in paralled with the longitudinal axis of each of said top and bottom panels.

8. A multi-way bag as claimed in claim 6, wherein said front panel is a flap panel swingably attached at a lower end thereof to a front edge of said bottom panel and arranged to be opened and closed by means of a zip fastener.

9. A multi-way bag as claimed in claim 6, wherein said bag has four pairs of slits which allow the strap to pass therethrough and which are formed in the back panel in such a manner that each two pairs of the slits are opposed to each other.

* * * * *